US011162220B2

(12) United States Patent
Singhal et al.

(10) Patent No.: US 11,162,220 B2
(45) Date of Patent: Nov. 2, 2021

(54) REFINER PLATE SEGMENTS WITH ANTI-LIPPING FEATURE

(71) Applicant: Andritz Inc., Glens Falls, NY (US)

(72) Inventors: Arvind M. Singhal, Folsom, CA (US); Peter Antensteiner, Lewisburg, PA (US)

(73) Assignee: ANDRITZ INC., Alpharetta, GA (US)

( * ) Notice: Subject to any disclaimer, the term of this patent is extended or adjusted under 35 U.S.C. 154(b) by 258 days.

(21) Appl. No.: 16/413,003

(22) Filed: May 15, 2019

(65) Prior Publication Data

US 2019/0376233 A1 Dec. 12, 2019

Related U.S. Application Data

(60) Provisional application No. 62/682,484, filed on Jun. 8, 2018.

(51) Int. Cl.
*D21D 1/30* (2006.01)
*B02C 7/12* (2006.01)

(52) U.S. Cl.
CPC ..... *D21D 1/306* (2013.01); *B02C 7/12* (2013.01); *D21D 1/303* (2013.01)

(58) Field of Classification Search
CPC ..... D21D 1/306; D21D 1/30; B02C 7/12
See application file for complete search history.

(56) References Cited

U.S. PATENT DOCUMENTS 2,988,290 A 6/1961 Merges
5,863,000 A * 1/1999 Gingras ..... B02C 7/12 241/28
5,944,271 A * 8/1999 Savujarvi ..... D21D 1/306 241/261.3

(Continued)

FOREIGN PATENT DOCUMENTS

CN 201713720 1/2011
EP 0899375 A2 3/1999

OTHER PUBLICATIONS

First Office Action, TW 108111728 application, pp. 1-15, Sep. 17, 2019, Taiwan.

(Continued)

*Primary Examiner* — Faye Francis
(74) *Attorney, Agent, or Firm* — Kilpatrick Townsend & Stockton LLP

(57) ABSTRACT

A refiner includes two or more facing refining assemblies. Each refining assembly includes a backing structure and refiner plate segments engaged to the backing structure A series of alternating bars and grooves defines a refining surface on each refiner plate segment. The refiner plate segments of the first refining assembly have a terminal edge perimeter defined by two or more terminal edges of bars disposed closest to the outer arc of the substrate of the first refining assembly. The refiner plate segments of the second refining assembly have an outermost edge circumference defined by an outermost terminal edge of a bar disposed closest to the outer arc of the substrate of the second refining assembly facing the first refining assembly. The terminal edge perimeter of the first refining assembly is not parallel to the outermost edge circumference of the second refining assembly.

13 Claims, 12 Drawing Sheets

(56) References Cited

U.S. PATENT DOCUMENTS

| | | | | |
|---|---|---|---|---|
| 6,325,308 | B1 * | 12/2001 | Lofgren | D21D 1/306 241/28 |
| 7,478,773 | B2 | 1/2009 | Gingras et al. | |
| 10,953,405 | B2 * | 3/2021 | Hedlund | B02C 7/12 |
| 2005/0167538 | A1 * | 8/2005 | Doelle | D21D 1/306 241/298 |
| 2019/0316295 | A1 * | 10/2019 | Anderson | D21D 1/306 |

OTHER PUBLICATIONS

J&L Fiber Services, model drawing, Jul. 28, 1998, United States.
J&L Fiber Services, product order form for refiner plates, United States.
J&L Fiber Services, pattern enlargement, United States.
Taiwanese Office Action, dated Aug. 27, 2020, pp. 1-6, Taipei, Taiwan.
Maisonnier, Claire; European Search Report, dated Nov. 11, 2019, pp. 1-9, Munich, Germany.
Application No. TW108119790 , Office Action, dated May 18, 2021, 3 pages with English translation.

* cited by examiner

REFINER PLATE SEGMENTS WITH ANTI-LIPPING FEATURE

RELATED APPLICATION

This application claims the benefit under 35 U.S.C. § 119(e) of the earlier filing date of U.S. Provisional Patent Application No. 62/682,484 filed on Jun. 8, 2018, the entire contents of which are incorporated herein by reference.

BACKGROUND OF THE INVENTION

Technical Field

The present disclosure relates generally to mechanical refiners configured to grind material into pulp, powders, or other particulate matter. The present disclosure relates more particularly to refiner plate segments for low-consistency refiners configured to separate, develop, and cut lignocellulosic material.

Related Art

In general, refiners can be characterized as either a high-consistency refiner ("HCR") or a low-consistency refiner ("LCR"). HCRs generally grind feed material down into particulate matter that can be used in a number of products. When the feed material is lignocellulosic material, mechanical pulping refiners typically separate, develop, and cut lignocellulosic material to endow the fibers with certain mechanical and physical properties. For example, depending upon the type and grade of refined material, the refined material may be suitable for producing pulp, paper, boards (such as medium density fiber boards), building materials, packing materials, and liquid-absorbent filler materials.

By contrast, LCRs are generally used to refine pulp. Pulp is a mixture of the fibers (wood or non wood) in water and this is usually at a consistency of 1.5% to 8%. The pulp may contain other additives.

Mill operators typically use low-consistency refining to mechanically fibrillate and cut the pulp fibers to provide desired quality. The refined material is generally then converted into different types of papers, and/or additives.

A refiner typically comprises two or more opposing refiner assemblies of like type. Each assembly has a pattern of raised refining bars on a refining side. Grooves separate adjacent refining bars. Typically, these refining assemblies are either circular discs, annular discs, nested cylinders, or nested conical frustums. Each refiner assembly may comprise several annular sector-shaped segments bolted to a backing structure to form the refiner circular disc, refiner annular disc, refiner cylinder, or refiner conical frustum. The refining sides of the opposing refining assemblies face each other to define a narrow refining gap separating the opposing refiner assemblies. At least one of the refining assemblies is a rotor configured to rotate around an axis at high speeds.

As the rotor refining assembly spins, operators pump cellulosic fibers or other feed material into the refiner and through the refining gap. The cellulosic fibers are generally tube-like structures comprising a number of concentric layers called "lamellae" or "fiber walls." Each lamella comprises finer structural components called "fibrils" that are bound to one another to form the lamella. The refining bars and grooves on opposing refiner assemblies successively overlap as the rotor spins. A typical low-consistency rotor refiner assembly spins in a range of about 325 rotations per minute ("rpm") 1,000 rpm. Pulp consistency may be at about 1.5% (i.e. the pulp and other solids concentration is about 1.5 units per every hundred units of water) to about 8%.

Successively overlapping opposing bars and grooves alternatively compress and permit expansion of pulp in the refining gap. This rapid alternating compression and expansion creates a fiber pad. Mechanical refining primarily occurs in the fiber pad. The friction delaminates the fibers and frays the fibrils that comprise the lamellae, thereby increasing the surface area of the fibers greatly. This in turn contributes to the strength of papers or other products manufactured from the fibrous pulp. In other words, forceful movement of feed material against adjacent feed material in the fiber pad contributes significantly to the fibers' development, separation, and cutting.

In operation, especially in low-consistency refiners, the outer circumference of the opposing refining assemblies generally do not align completely. The cause may vary depending upon the type of refiner. For example, in disc and conical refiners comprising a rotor assembly and a stator assembly, one such cause may be the design of the refiner plate segments' fastener holes.

Manufacturers typically design a refiner plate's fastener holes to be slightly larger than the fastener holes on the backing structure. Manufacturers do this to accommodate small variations in the casting process and to improve the likelihood that the refiner plate's fastener holes will align with the fastener holes in the backing structure. These slightly larger fastener holes can also create a small amount of play or "give" when the refiner plate segment engages the backing structure. The play allows the rotor refiner plate segments to slide radially outwardly slightly when the rotor refiner assembly spins, thereby misaligning the terminal edges of the refining bars between opposing refining assemblies.

For another example, operators may elect to install different sets of rotor and stator plate segments. Manufacturers may have designed the elected refiner plate segments for different purposes, and as such, the elected refiner plate segments may have different dimensions. As a result, at various times in a rotation, the outer edges of the bars on one or more plate segments may be disposed radially outward of the outer edges of the bars on the facing plate segments.

Bars that overlap between facing refiner plate segments tend to wear away at a similar rate. These refining bars extend generally toward the outer circumference of the refining assemblies. If the outer circumference of an operational refining assembly exceeds the outer circumference of the facing refining assembly, the radially outermost edges of the bars may not face any bars on the opposing refining assembly, thereby leading to an uneven wear pattern. Stated differently, wear generally occurs where the segments overlap. The outer portions of the refiner plate segments do not overlap, thereby permitting uneven wear and lip formation on at least one set of refiner plate segments.

These "lips" or a "teeth" near the outer arc of the refiner plate segment cut the fibers exiting the refining gap. In this manner, the lips shorten the fibers and reduce the quality of the refined material. For example, papers manufactured from short fibers tend to have weaker strength compared to papers manufactured from longer fibers. In the past, operators have attempted to address this issue through adopting maintenance best practices (e.g. installing plates that are not misaligned). However, even these best practices still leaves the lipping issues at many locations. For example, taking appropriate amount of time to align the opposing refining assemblies properly can delay installation and result in prolonged production loss. Furthermore, many modern refiners lack a retaining ring on the outer diameter ("O.D.") of the stator, which some installers previously used to attempt to align the opposing refining assemblies.

Others have previously attempted to mitigate the formation of lips through the use of full discs rather than segments. However, even the use of complete discs requires precision alignment and the time pressure to install replacement refiner plates quickly often precludes precision alignment. Furthermore, this solution is practical for only for swing door model refiners and for refiners having a diameter of about 24 inches or less. When the refiner disk size exceeds 26 inches, the installation of the whole disk becomes difficult and requires cranes and forklift trucks. Full discs have more mass and more pinch points. Installers generally work close to the mounting disc to install full discs and even the most precise cranes typically have minimal incremental movements in the order or inches and not millimeters. Full circle plates therefore crease in tight spaces during installation, create serious safety risks, and have the potential to extend losses of production during installation and maintenance periods should an accident or injury occur.

Accordingly, there is a long felt and unresolved need to mitigate the problem of cutting fibers at the radially outermost edges of non-overlapping bars to improve fiber quality.

SUMMARY OF THE INVENTION

The problem of cutting fiber at the radially outermost edges of non-overlapping bars due to uneven wear between the outermost edges of opposing refiner plate assemblies and the problem of lip formation due to non-aligned opposing refiner plate segments due to hasty installation is mitigated by using a mechanical refiner comprising at least two facing refining assemblies, wherein each refining assembly comprises a backing structure and refiner plate segments engaged to the backing structure, each refiner plate segment comprising a substrate having an outer arc, and a series of alternating bars and grooves disposed on the substrate, wherein an area between the bars and the substrate defines a groove, wherein the series of alternating bars and grooves defines a refining surface, wherein a first refining assembly of the at least two facing refiner assemblies is configured to rotate around an axis of rotation, wherein the refining surface of the first refining assembly faces the refining surface of the second refining assembly, wherein the refiner plate segments of the first refining assembly have an terminal edge perimeter defined by two or more terminal edges of bars disposed closest to the outer arc of the substrate of the first refining assembly, wherein the refiner plate segments of the second refining assembly have an outermost edge circumference defined by an outermost terminal edge of a bar disposed closest to the outer arc of the substrate of the second refining assembly facing the first refining assembly, and wherein the terminal edge perimeter of the first refining assembly is not parallel to the outermost edge circumference of the second refining assembly.

The refining assembly preferably comprises a series of refiner plate segments.

It is contemplated that certain exemplary embodiments described herein may reduce the amount of lips created at the terminal edges of the bars on at least one of the refining assemblies.

It is further contemplated that any lips that do form on exemplary refiner plate segments described herein may be shorter and less pronounced than lips formed from conventional misaligned refiner plate segments.

Certain exemplary embodiments may allow installers to replace worn refiner plate segments faster than previously possible during down time while prolonging the pulp quality produced per unit of energy consumed during run time due to the reduction in overall lip formation.

BRIEF DESCRIPTION OF THE DRAWINGS

The foregoing will be apparent from the following more particular description of exemplary embodiments of the disclosure, as illustrated in the accompanying drawings. The drawings are not necessarily to scale, with emphasis instead being placed upon illustrating the disclosed embodiments.

FIG. 2B depicts the lips exuding above a common wear plane.

FIG. 3B depicts the lips exuding above a common wear plane.

DETAILED DESCRIPTION OF THE INVENTION

Figure 1A:
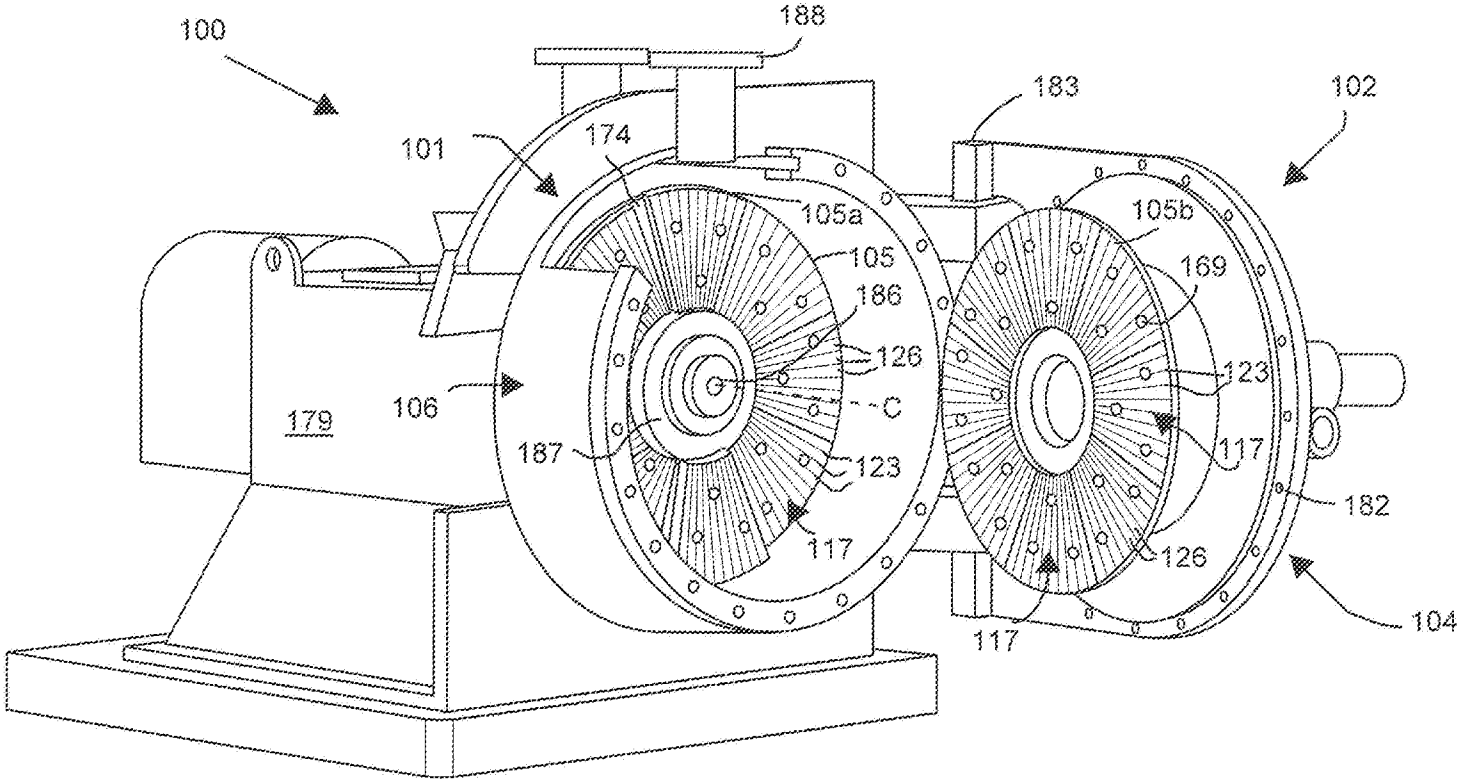
FIG. 1A (Prior Art)
FIG. 1A is a perspective view of a low-consistency disc refiner.

The following detailed description of the preferred embodiments is presented only for illustrative and descriptive purposes and is not intended to be exhaustive or to limit the scope and spirit of the invention. The embodiments were selected and described to best explain the principles of the invention and its practical application. One of ordinary skill in the art will recognize that many variations can be made to the invention disclosed in this specification without departing from the scope and spirit of the invention.

Similar reference characters indicate corresponding parts throughout the several views unless otherwise stated. For example, 218, 318, 518, to 918 all indicate the first lateral side of a depicted refiner plate segment. Although the drawings represent embodiments of various features and components according to the present disclosure, the drawings are not necessarily to scale and certain features may be exaggerated in order to better illustrate embodiments of the present disclosure, and such exemplifications are not to be construed as limiting the scope of the present disclosure.

Except as otherwise expressly stated herein, the following rules of interpretation apply to this specification: (a) all words used herein shall be construed to be of such gender or number (singular or plural) as to circumstances require; (b) the singular terms "a," "an," and "the," as used in the specification and the appended claims include plural references unless the context clearly dictates otherwise; (c) the antecedent term "about" applied to a recited range or value denotes an approximation within the deviation in the range or values known or expected in the art from the measurements; (d) the words "herein," "hereby," "hereto," "hereinbefore," and "hereinafter," and words of similar import, refer to this specification in its entirety and not to any particular paragraph, claim, or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms, "comprising," "having," "including," and "containing" are to be construed as open-ended terms (i.e., meaning "including but not limited to").

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

To the extent necessary to provide descriptive support, the subject matter and/or text of the appended claims is incorporated herein by reference in their entirety.

Recitation of ranges of values herein are merely intended to serve as a shorthand method of referring individually to each separate value falling within the range of within any sub ranges there between, unless otherwise clearly indicated herein. Each separate value within a recited range is incorporated into the specification or claims as if each separate value were individually recited herein. Where a specific range of values is provided, it is understood that each intervening value, to the tenth or less of the unit of the lower limit between the upper and lower limit of that range and any other stated or intervening value in that stated range or sub range hereof, is included herein unless the context clearly dictates otherwise. All subranges are also included. The upper and lower limits of these smaller ranges are also included therein, subject to any specifically and expressly excluded limit in the stated range.

It should be noted that some of the terms used herein are relative terms. For example, the terms "upper" and "lower" are relative to each other in location, i.e. an upper component is located at a higher elevation than a lower component in a given orientation, but these terms can change if the device is flipped. The terms "inlet" and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the flow of fluids through an upstream component prior to flowing through the downstream component.

The terms "horizontal" and "vertical" are used to indicate direction relative to an absolute reference, i.e. ground level. However, these terms should not be construed to require structure to be absolutely parallel or absolutely perpendicular to each other. For example, a first vertical structure and a second vertical structure are not necessarily parallel to each other. The terms "top" and "bottom" or "base" are used to refer to locations/surfaces where the top is always higher than the bottom/base relative to an absolute reference, i.e. the surface of the Earth. The terms "upwards" and "downwards" are also relative to an absolute reference; an upwards flow is always against the gravity of the Earth.

FIG. 1A depicts a disc refiner 100. The figure depicts a first refining assembly 101 having a top and a bottom refiner plate segment 105 that is partially removed from the backing structure 174 to depict how refiner plate segments 105 are mounted to the first refining assembly 101. The first refining assembly 101 is oppositely disposed from a fully assembled second refining assembly 102. The first refining assembly 101 is a rotor refining assembly configured to spin around an axis of rotation C. The second refining assembly 102 is a stator refining assembly. The first and second refining assemblies 101, 102 sit within a housing 179. Each refining assembly 101, 102 comprises a plurality of refiner plate segments (shown as 105*a* on the first refining assembly 101 and 105*b* on the second refining assembly 102) annularly arrayed to form a ring mounted on the backing structure 174. FIG. 1A shows the housing's stator side 104 open around hinges 183 to better depict the respective refining assemblies 101, 102. However, for operation, the stator side 104 closes around the hinge 183 and fasteners (not depicted) extend through the respective fastener holes 182 to fixedly engage the housing's stator side 104 to the rotor side 106. When the second refining assembly 102 and first refining assembly 101 face each other, the second refining assembly 102 and the first refining assembly 101 define a gap 449 (FIG. 4) between the refining surfaces 117 of the facing refiner plate segments 105*a*, 105*b*. Where useful to improve precision when discussing features on the first refining assembly in relation to facing features on the second refining assembly, Applicant will use an "a" to refer to particular features on the first refining assembly 101 and a "b" to refer to particular features on the second refining assembly 102. Where no relation is discussed and no "a" or "b" designation is used, it will be understood that the particular refining assembly elements may exist generally on both the first refining assembly 101 and the second refining assembly 102.

Bolts or other fasteners (not depicted) may extend through plate fastener holes 169 to engage the refiner plate segments 105 to the backing structure 174 and thereby fixedly engage the annular sector-shaped refiner plate segments 105 to the backing structure 174.

Figure 1B:
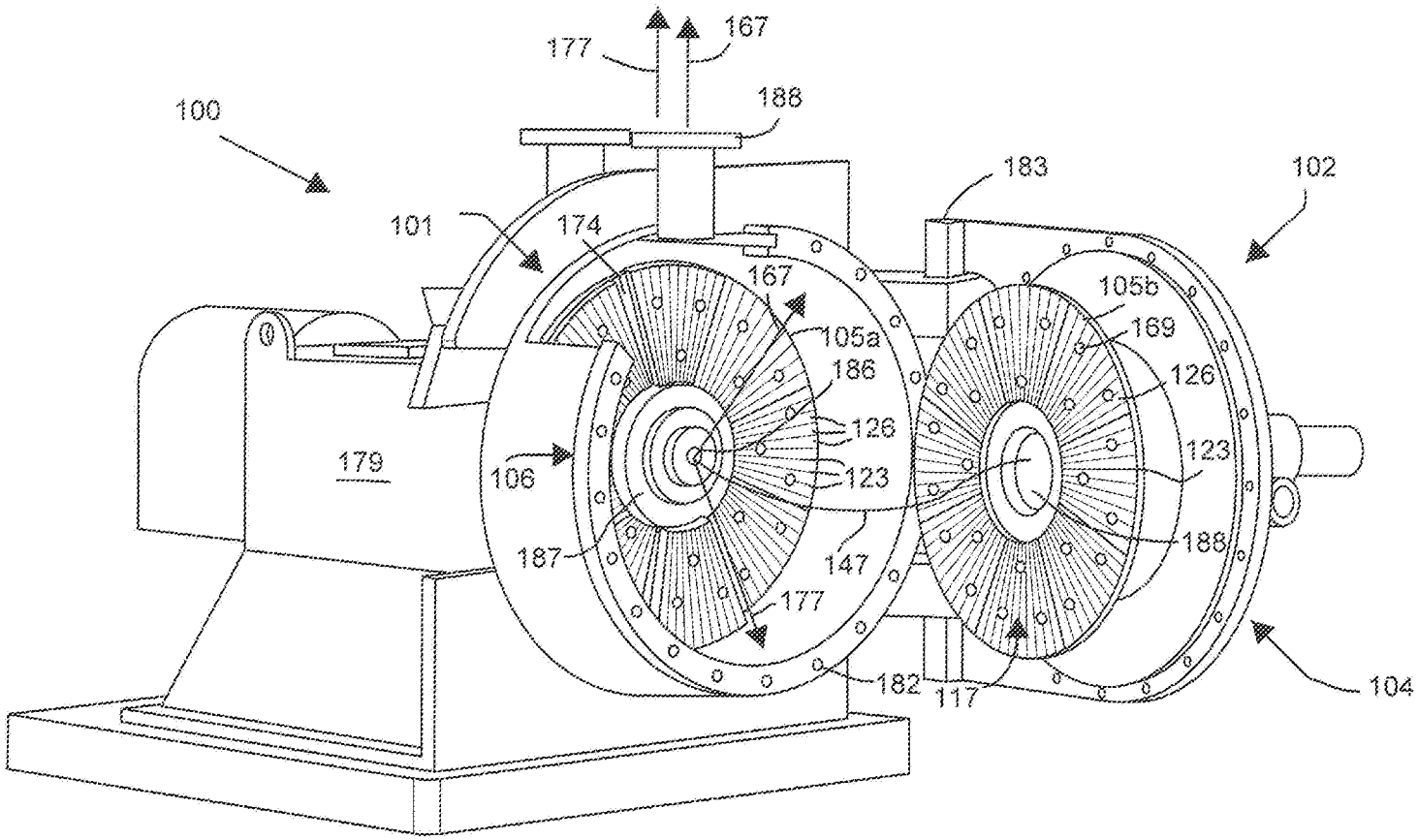
FIG. 1B (Prior Art)
FIG. 1B is a perspective view of a fully assembled low-consistency disc refiner showing an open rotor side and stator side.

In an active refiner 100, feed material 147 (FIG. 1B), which may be lignocellulosic feed material (commonly in the form of wood chips), flows through an opening 181 in the center of the stator refining assembly (see 102) before encountering the rotor hub 186 or rotor flinger 187. The rotor refining assembly (see 101) typically spins around the axis of rotation C in a range of 325 rpm to 960 rpm, and thereby flings the feed material 147 radially outwardly and into the gap 449. Breaker bars (not depicted, but are generally wider versions of refiner bars 123) may break down the feed material 147 before the feed material 147 flows still further through the gap 449 (FIG. 4) and traverses a refining surface 117 defined by alternating refining bars 123 and refining grooves 126 on opposing refiner plate segments 105*a* and 105*b*. The refined material 177 and partially ground material 167 exits the refiner 100 through an outlet 188. Operators may then screen the desirably refined material 177 from the partially ground material 167 and transfer the partially ground material 167 to a second stage refiner (see 100). Operators may chemically treat the partially ground material 167 in lieu of or in addition to subjecting the partially ground material 167 to further refining.

Figure 2A:
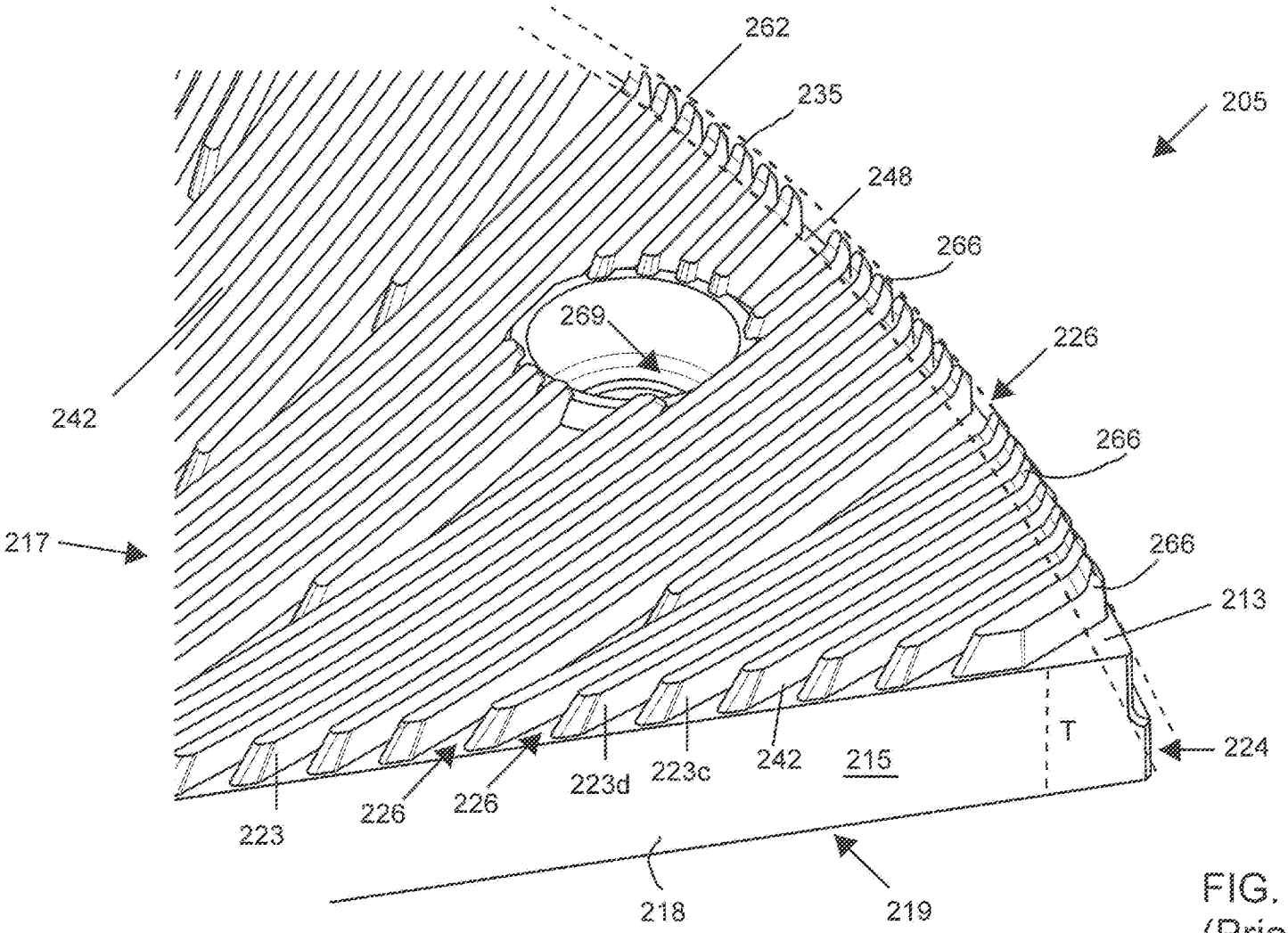
FIG. 2A (Prior Art)
FIG. 2A is a perspective view of a conventional refiner plate segment having a lip near the outer arc of the refiner plate segment's substrate.

FIG. 2A is a perspective view of part of a worn conventional refiner plate segment 205 having a lip 266 near the outer arc 224 of the refiner plate segment's substrate 215. The depicted refiner plate segment 205 may be a part of a first, rotor refining assembly (see 101) for example. FIG. 2A depicts the refiner plate segment's first lateral side 218 disposed between the refiner plate segment's front face 213 and back face 219 along a thickness T of the substrate 215. One or more plate fastener holes 269 extend through the substrate 215. The refining surface 217 comprises a series of alternating bars 223 and grooves 226 disposed between adjacent bars 223*c*, 223*d*.

Figure 4:
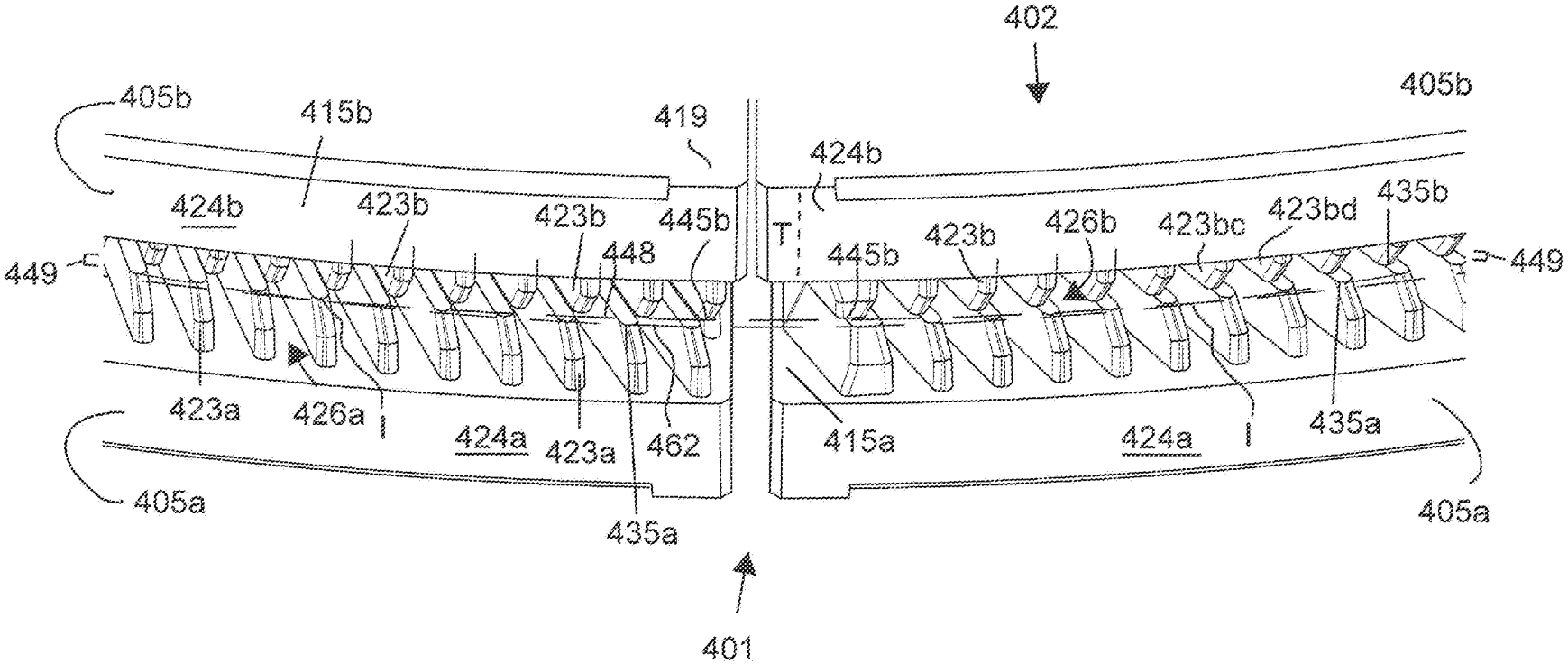
FIG. 4 is a close up perspective view of opposing refiner plate segments on opposing refining assemblies showing the crossing of the terminal edge perimeter and the outermost edge circumference.

Although FIG. 2A does not depict an opposing refiner plate segment facing the refining surface 217 of the depicted refiner plate segment 205, the curved line 248 represents an outermost edge circumference 248 of the second refining assembly 102 (see FIG. 4 for an exemplary embodiment of the present invention showing a first refining assembly 401 having refiner plate segments 405*a* facing refiner plate segments 405*b* on a second refining assembly 402). The outermost terminal bar edge (see 445, FIG. 4) of a bar (423*a*) disposed closest to the outer arc (424*a*) of the substrate (415*a*) of a refiner plate segment (405*a*) defines a curve as the outermost terminal bar edge (see 445) moves around the center of rotation C (FIG. 1A). This curve will be referred to as an "outermost edge circumference" 248 throughout this disclosure. It will be further understood that if the second refining assembly 102 is a stator refining assembly, then the "outermost edge circumference" 248 is defined by that path the outermost terminal bar edge (see 445) would take if the stator refining assembly were to rotate around the center of rotation C. With reference to the depicted refiner plate segment 205, a line 262 can be inferred to connect the radially terminal edges 235 of the bars 223 disposed closest to the outer arc 224 of the substrate 215 to define a terminal edge perimeter 262. In FIG. 2A, the terminal edge perimeter 262 is parallel to the outermost edge circumference 248 on the facing refiner plate segment (see 105*a*), particularly along a radial plane. The outermost edge circumference 248 is disposed radially inward of the terminal edge perimeter 262.

Without being bound by theory, it is believed that the portion 242 of bars 223 facing a refining surface (see 217) on the opposing refiner plate segment (see FIG. 4) wear away at substantially even rates. The lack of facing refiner bars disposed radially outward from the outermost edge circumference 248 may allow the terminal edges 235 of the depicted bars 223 to wear away more slowly than the portion 242 of the bars 223 disposed radially inward of the outermost edge circumference 248.

For example, new refining bars 223 may have a height of about 6 millimeters ("mm") to 10 mm. Over time, overlapping facing refining bars (see 423*a*, 423*b*) on facing refiner plate segments (see 405*a*, 405*b*) can wear down to heights between about 2 mm to 4 mm. However, the terminal edges 235 of the bars 223 on the refiner plate segment 205 that do not face the bars (see 423*b*) on the opposing refiner plate segment (see 405*b*) retain much of their original height h, thereby creating "lips" or "teeth" over time. The lips 266 cut the partially ground 167 and refined material 177 (FIG. 1B) exiting the refining gap 449 (FIG. 4). If the refined material 177 (FIG. 1B) is pulp, and if the pulp is manufactured into paper, the paper tends to have less strength than papers made from pulps having longer fibers. As a result, once the lips 266 form, the refiner 100 uses the same amount of energy to produce inferior quality pulp.

Figure 2B:
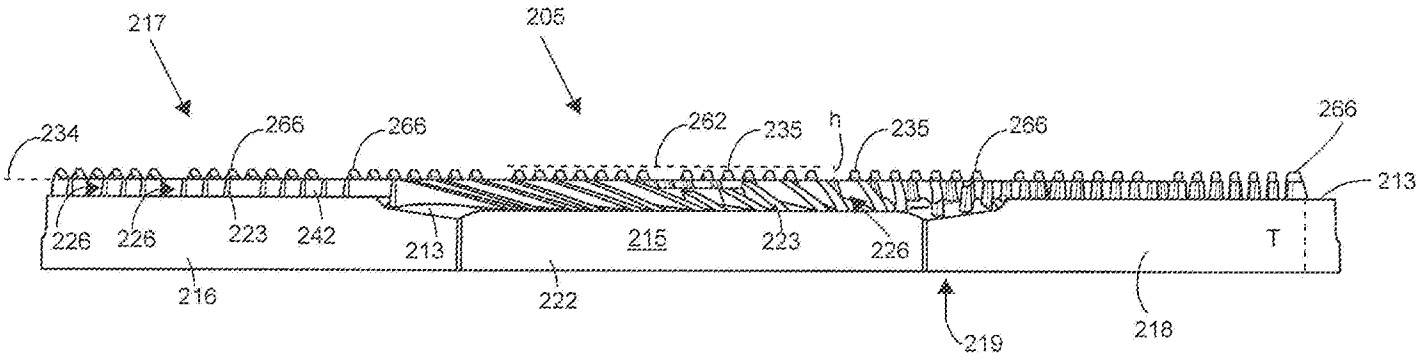
FIG. 2B (Prior Art)
FIG. 2B is a view of the conventional refiner plate segment of FIG. 2A facing the inner arc and lateral sides.

FIG. 2B is a facing view of the inner arc 222 and lateral sides 218, 216 of the refiner plate segment 205 of FIG. 2A. Over time, the portions 242 of the bars 223 disposed radially inward of the outermost edge circumference 248 (see FIG. 2A) define a wear plane 234. As the lips 266 form, the lips 266 extend transversely past the wear plane 234 into the refining gap 449, thereby being in a position to cut the refined material 177 as the refined material 177 exits the refining gap 449.

Figure 3A:
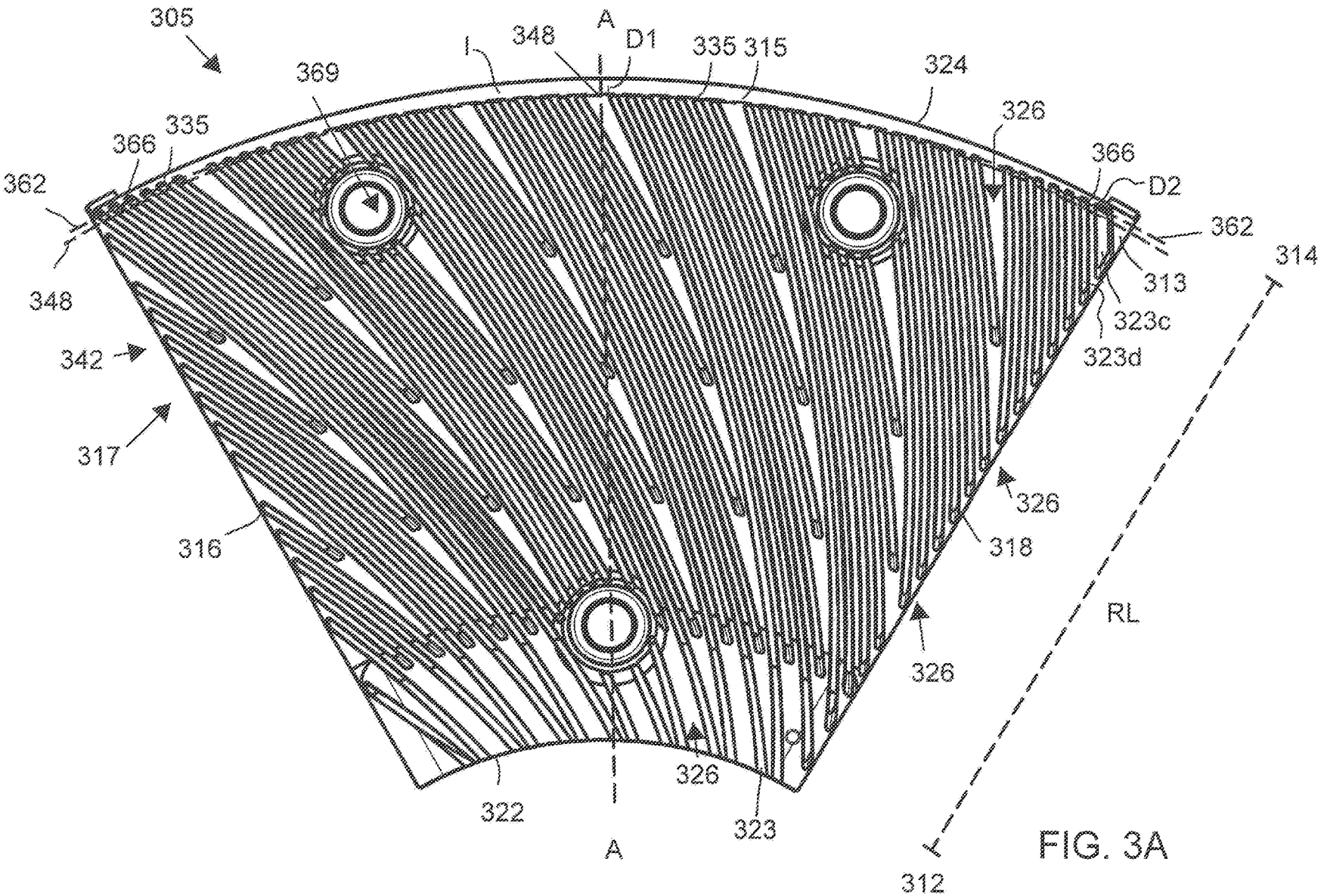
FIG. 3A is a facing view of the refining surface of an exemplary refiner plate segment comprising a terminal edge perimeter that overlaps the facing outermost edge circumference.

FIG. 3A depicts the front face 313 and refining surface 317 of an exemplary refiner plate segment 305 comprising a series of raised bars 323 engaged to substrate 315. The substrate 315 has an inner arc 322 disposed at a first end 312 of the radial length RL and an outer arc 324 disposed at a second end 314 of the radial length RL. The second end 314 of the radial length RL is distally located from the first end 312 of the radial length RL. A first lateral side 318 extends between the outer arc 324 and the inner arc 322 along the radial length RL. A second lateral side 316 similarly extends between the outer arc 324 and the inner arc 322 along the radial length RL. The second lateral side 316 is distally disposed from the first lateral side 318 (i.e. the substrate 315, the inner arc 322, and the outer arc 324 separate the first lateral side 318 from the second lateral side 316.)

Adjacent bars (e.g. 323*c* and 323*d*) and the front face 313 of the substrate 215 define a groove 326 between the adjacent bars 323*c*, 323*d*. Likewise, the series of raised bars 323 engaged to the substrate 315 and extending from the front face 313 create a series of alternating bars 323 and grooves 326. These series of alternating bars 323 and grooves 326 define the refining surface 317.

FIG. 3A further depicts bars 323 near the outer arc 324 having a terminal edge 335 disposed near the outer arc 324. A line or a curve 362 may be inferred to connect the terminal edges 335 of the bars 323 disposed near the outer arc 324 of the substrate 315. This line or curve 362 defines a terminal edge perimeter 362. The terminal edge perimeter 362 is not parallel to the outer arc 324 of the refiner plate segment 305. In the depicted embodiment, the terminal edge perimeter 362 is an arc. In other exemplary embodiments, the terminal edge perimeter 362 may comprise one or more lines disposed at an edge angle Θ (see FIG. 5). In certain exemplary embodiments, will be understood that this disclosure includes all arrangements or dispositions of a terminal edge perimeter 362 provided that the terminal edge perimeter 362 is not parallel to the outer arc 324. The dotted line 348 represents the outermost edge circumference 348 of the facing refiner plate segment (see 405*b*) defined by the outermost terminal bar edge (see 445) of the bars (see 423*b*) of the facing refiner plate segment (see 405*b*). In the depicted embodiment, the terminal edge perimeter 362 is not parallel to the facing outermost edge circumference 348 along a radial plane. In this exemplary embodiment, the terminal edge perimeter 362 overlaps the facing outermost edge circumference 348 at bifurcation line A-A when the refiner plate segment 305 completely faces the opposing refiner plate segment (see 405*b*). It will be understood that this disclosure includes all arrangements or dispositions of a terminal edge perimeter 362 provided that the terminal edge perimeter 362 is not parallel to the facing outermost edge circumference 348 defined by the a refiner plate segment 305 on a facing refiner assembly (see 401, 402).

However, in the depicted embodiment, the terminal edges 335 of the bars 323 disposed near the bifurcation line A-A are separated from the outer arc 324 of the refiner plate segment 305 by a greater distance D1 than the terminal edges 335 of the bars 323 disposed at both the first lateral side 318 and the second lateral side 316 (i.e. the lesser distance D2). In this manner, the surface area of the substrate 315 between the terminal edge perimeter 362 and the outer arc 324 of the refiner plate segment 305 defines a lune 1 (i.e. a crescent-like geometric shape defined by two intersecting circles, ovoids, or other rounded shape). Applicant notes that a "crescent" is a particular type of lune defined by two intersecting circles of the same size. It will be appreciated that increasing the distance D between some of the terminal edges 335 of the bars 323 and the outer arc 324 will encroach on the refining surface 315 and thereby reduce the work of the refining surface 315 is capable of preforming on the feed material 147.

However, is contemplated that the lune-shaped surface area 1 represents a shape that can offer minimal loss to the refining surface 315 while also offering significant reduction in lipping. It is contemplated that the mitigation of quality problems caused by excessing lipping may well exceed the slight loss in refining surface area 315.

Without being bound by theory, Applicant believes that the outermost edge circumference 348 overlapping with the terminal edge perimeter 362 increases the portions 342 of the bars 323 disposed radially inward of the outermost edge circumference 348, thereby reducing the number of bars 323 that develop a lip 366 over time. The exemplary embodiments disclosed herein may effectively increase the area of the wear plane 334 to the terminal edges 335 of most bars 323 on a refiner plate segment 305. However, the disclosed design still causes some lips 366 near the radially outermost corners of the refiner plate segment 305. Without being bound by theory, Applicant believes that any remaining periphery lips 366 will be shorter than lips (see 266) created through conventional refiner plate segment designs and arrangements due in part to the fact that p=F/A when forced is applied perpendicular to a surface area. In this formula, "p" is pressure, "F" is the force, and "A" is the surface area. Stated practically, the pressure of the partially ground material 267 and refined material 277 moving past the remaining periphery lips 366 will increase (compared to pressure of the of the partially ground material 267 and the refined material 277 on the lips 266 depicted in FIG. 2A when all other factors are the same) due to the smaller surface area of the periphery lips 366. As a result, the remaining periphery lips 366 will be both be fewer in number and less obtrusive compared to conventional lips (see 266).

Although FIG. 3A depicts a pattern of bars 323 and grooves 326 fanning substantially radially outward from the center of rotation C, the scope of this disclosure is intended to include all patterns of bars 323 and grooves 326 on a refining plate segment 305 wherein bars 323 have a terminal edge 335 disposed near the outer arc 324.

Furthermore, although not depicted, it will be understood that exemplary refiner plate segments disclosed herein may also be configured for use in a conical refiner or a cylindrical refiner. Other types of refiners 100 compatible with the disclosed refiner plate segments 305 include, but are not necessarily limited to, counter-rotating refiners comprising two counter-rotating rotor assemblies, and multi-assembly refiners comprising multiple refining assemblies (see 101 and 102).

Figure 3B:
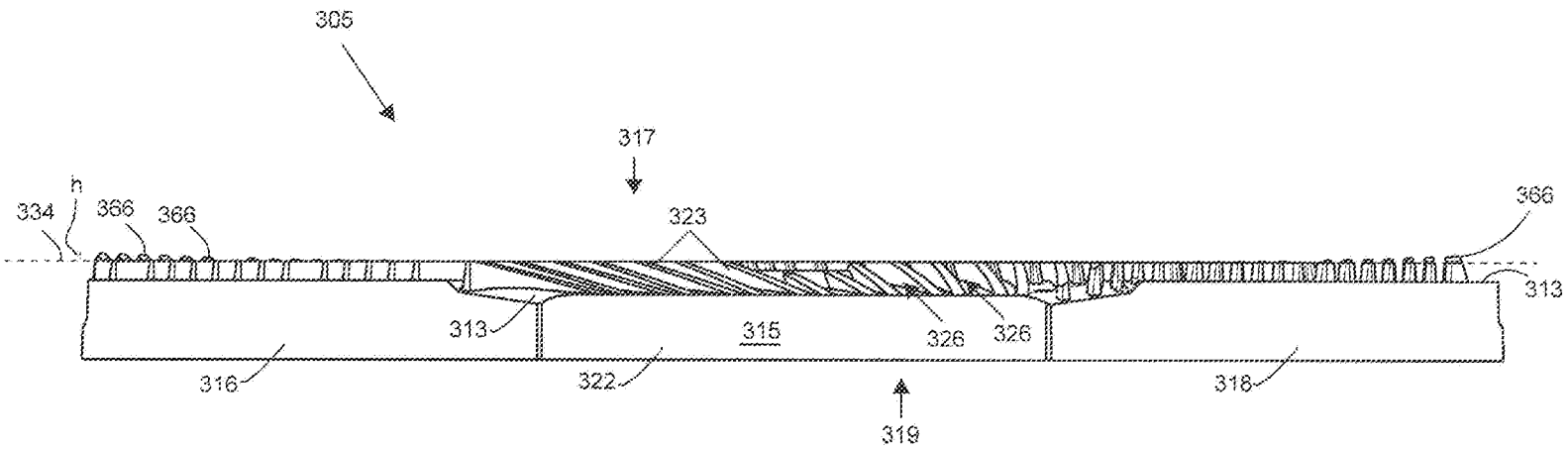
FIG. 3B is a facing view of the inner arc and lateral sides of the exemplary refiner plate segment depicted in FIG. 3A.

FIG. 3B is a view facing the inner arc 322 and lateral sides 316, 318 of the exemplary refiner plate segment 305 shown in FIG. 3A. Without being bound by theory, the exemplary embodiments disclosed herein may further reduce the height h of the remaining peripheral lips 366 because the exiting refined material 177 and partially ground material 167 will exert the same frictional pressure over a smaller area. In this manner, the frictional pressure may be concentrated on the remaining lips 366 and erode the remaining lips 366 at an increased rate over refiner plate segments that lack a non-parallel terminal edge perimeter 362 and facing outermost edge circumference 348 (see FIG. 2A). While the disclosed embodiments may not eliminate the lips 366 completely, the disclosed embodiments can reduce the number of lips and the height h of the remaining lips 366 thereby mitigating unintended damage to the refined material 177.

FIG. 4 schematically depicts a close up of a second refining assembly 402 disposed over a first refining assembly 401 to define a gap 449 between the first refining assembly 401 and the second refining assembly 402. A thickness T separates the back face 419 of a refiner plate segment 405 from the front face (see 313).

The refining surface 317 (see FIG. 3) of a refiner plate segment 405*b* on the second refining assembly 402 has a refining bar 423*b* with an outermost terminal bar edge 445*b* disposed closest to the outer arc 424*b* of the substrate 415*b*. Although the depicted close up shows one outermost terminal bar edge 445*b* per refiner plate segment 405*b*, it will be understood that other exemplary embodiments may have multiple outermost terminal bar edges 445*b* per refiner plate segment 405*b*. The outermost terminal bar edge 445*b* defines a curve as the outermost terminal bar edge 445*b* moves around the center of rotation C (FIG. 1A). The path of the outermost terminal bar edge 445*b* after one rotation creates an "outermost edge circumference" 448. As used herein, the term, "outermost edge circumference" can be used to refer to either the entire circumference or a segment of the circumference depending upon context.

On the refiner plate segment 405*a* of the first refining assembly 401, a line 462 may be inferred to connect terminal edges 435*a* of the bars 423*a* disposed closest to the outer arc 424*a*. Although the opposing refiner plate segments 405*b* and 405*a* do not physically contact each other during refining, from the angle depicted in FIG. 4, the terminal edge perimeter 462 of the first refining assembly 401 overlaps the outermost edge circumference 448 of the second refining assembly 402. From the perspective of FIG. 4, the terminal edge perimeter 462 appears to intersect the outermost edge circumference 448 at points I. In this manner, the terminal edge perimeter 462 is not parallel to the outermost edge circumference along a radial plane. Stated another way, the terminal edge perimeter 462 and the outermost edge circumference 448 are not equidistant from the axis of rotation C at all points extending radially outward from the axis of rotation C.

FIGS. 5-9 show other exemplary embodiments in which the terminal edge perimeters 562, 662, 762, 862, and 962 of the depicted refiner plate segments 505, 605, 705, 805, and 905 respectively are configured to form a regular polygon when comprising a complete refining assembly. The second refining assembly (see 402) has been removed to better illustrate the shape of the terminal edge perimeters 562, 662, 762, 862, and 962 respectively. While not depicted, it is contemplated that the shape of the terminal edge perimeter (see 562, 662, 762, 862, and 962) when comprising a complete refining assembly may take any shape provided that the shape of the terminal edge perimeter is not parallel to the outermost edge circumference 448 of the opposing refining assembly. Such shapes may comprise: a rounded polygon, a regular polygon, an irregular polygon, an ovoid, joined hyperbola, and combinations thereof. When the refiner plate segments are not disposed in a refining assembly, the terminal edge perimeter 562, 662, 762, 862, and 962 on a single refiner plate segment 605 may be disposed in: a line segment, a series of line segments, a curve (whether concave or convex), a series of curves, or the like, and combinations thereof.

Figure 5:
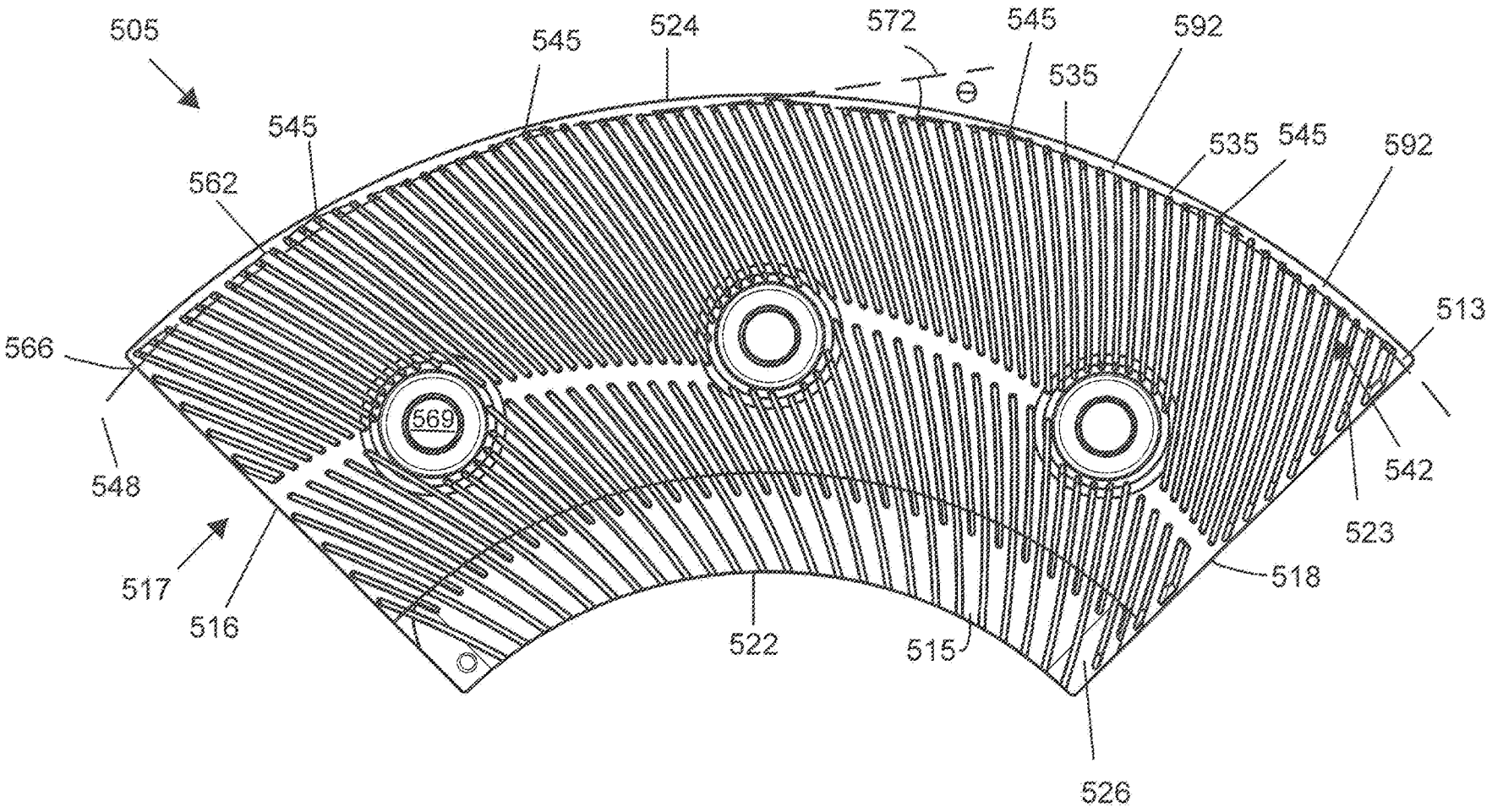
FIG. 5 is a facing view of the refining surface of an exemplary refiner plate segment, wherein the terminal edge would perimeter form a 24-sided polygon on a fully assembled refining assembly, wherein about 50% of the bars extend radially past the outermost edge circumference.

FIG. 5 depicts the terminal edge perimeter 562 forming a 24-sided polygon, wherein about 50% of the bars 523 on the first refining assembly 401 extend radially past the outermost edge circumference 548 of the second refiner assembly (see 402). In the depicted embodiment, the surface area of the front face 513 between the terminal edges 535 of the bars 523 and the outer arc 524 defines a chord segment 592 bounded by adjacent outermost terminal bar edges 545. The depicted embodiment shows six chord segments 592. Although the outermost terminal bar edges 545 extend to the outer arc 524 in the depicted embodiment, it will be understood that in other exemplary embodiments, the outermost terminal bar edges 545 may not extend to the outer arc 524.

Figure 6:
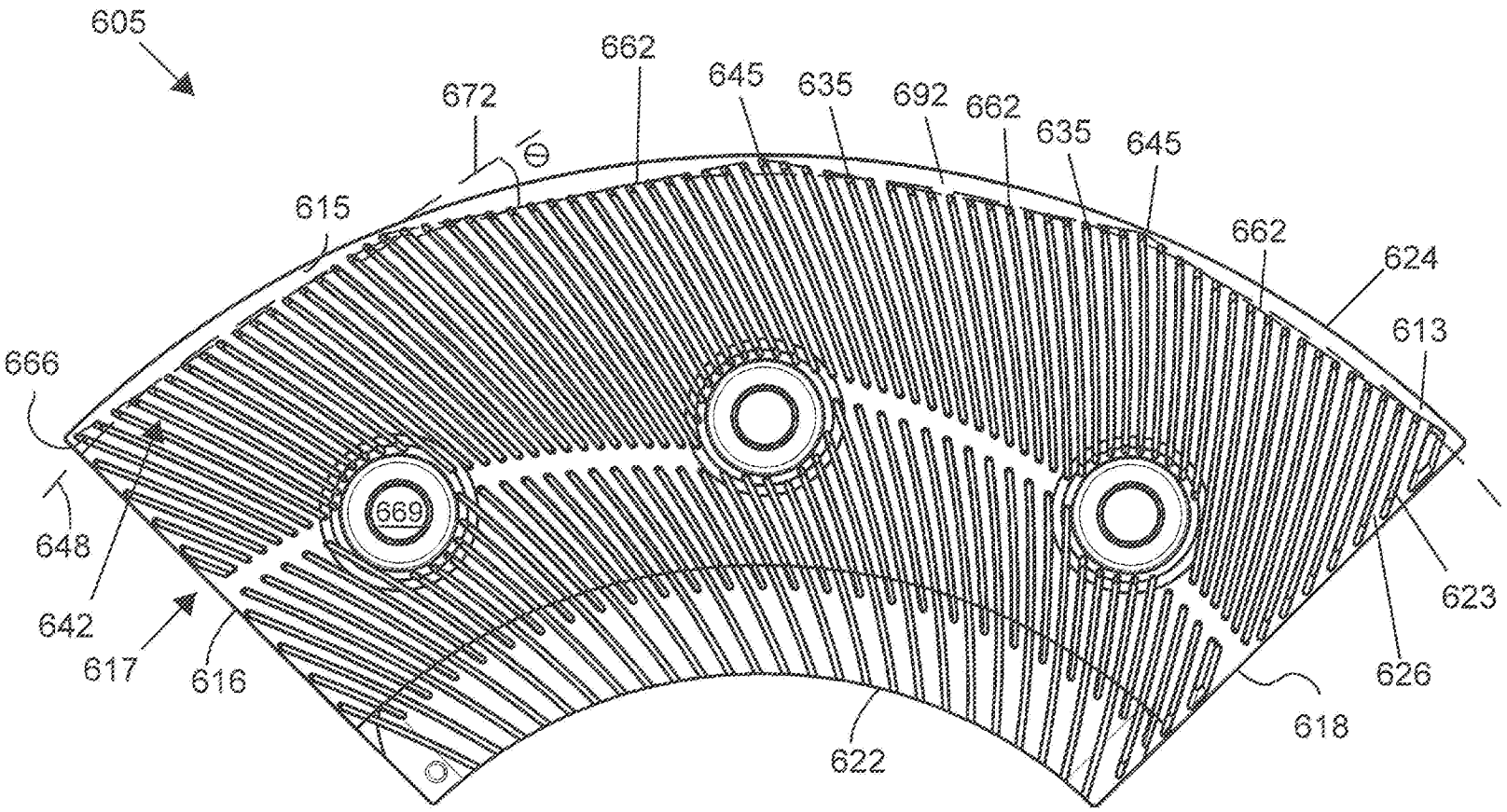
FIG. 6 is a facing view of the refining surface of an exemplary refiner plate segment, wherein the terminal edge perimeter would form a sixteen-sided polygon on a fully assembled refining assembly, wherein about 15% of the bars extend radially past the outermost edge circumference.
Figure 7:
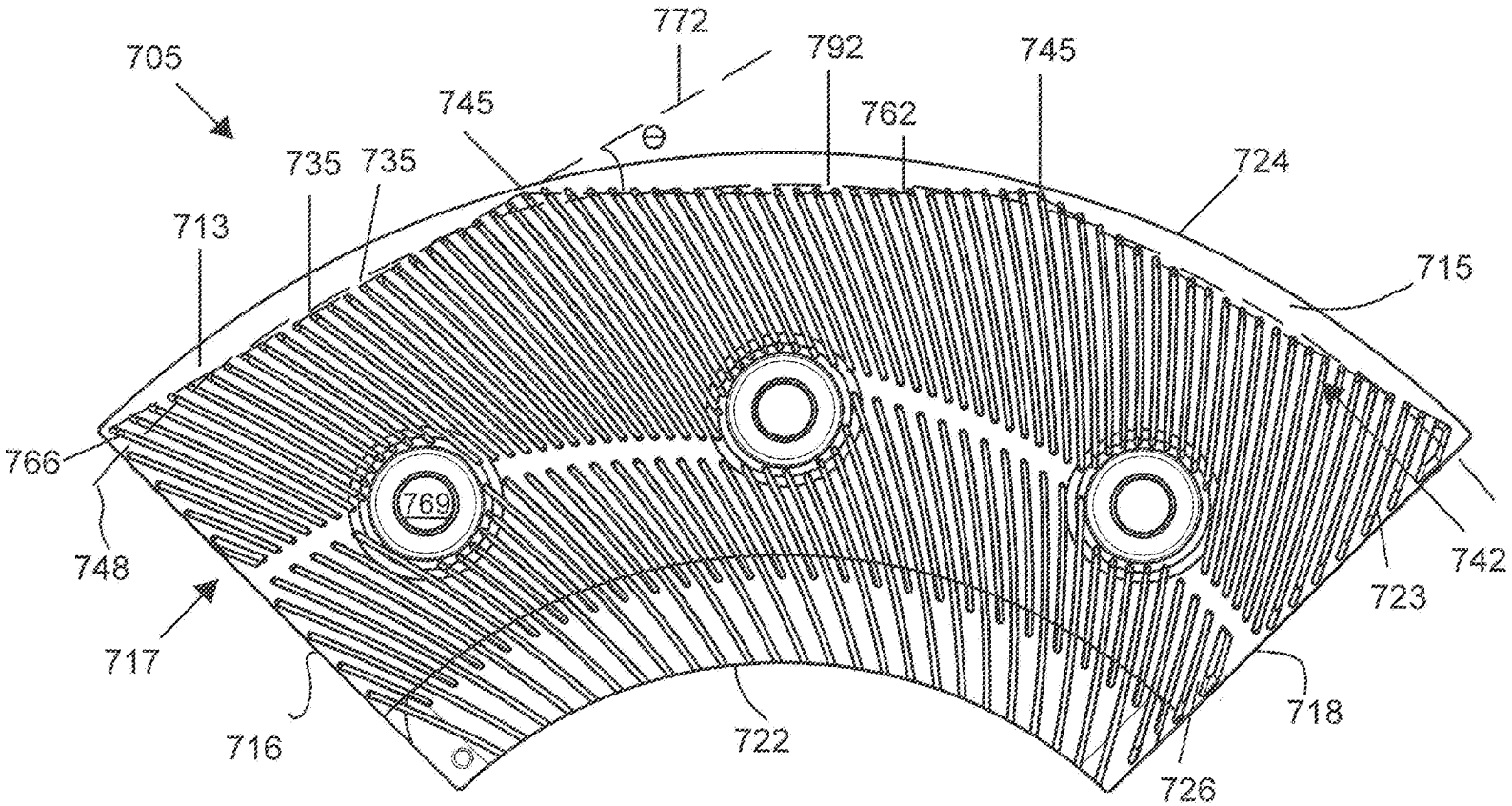
FIG. 7 is a facing view of the refining surface of an exemplary refiner plate segment, wherein the terminal edge perimeter would form a twelve-sided polygon on a fully assembled refining assembly, wherein about 8% of the bars extend radially past the outermost edge circumference.
Figure 8:
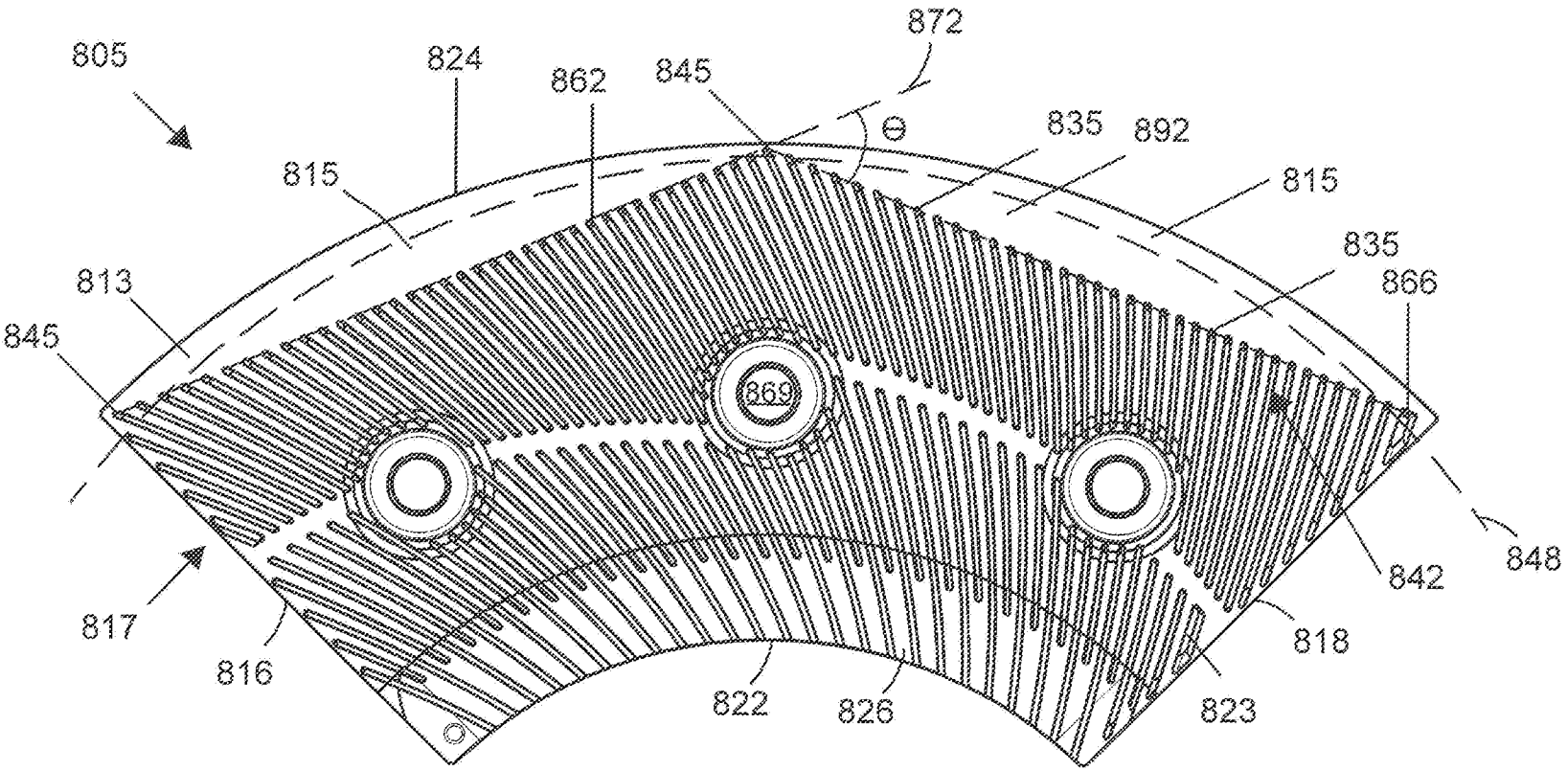
FIG. 8 is a facing view of the refining surface of an exemplary refiner plate segment wherein the terminal edge perimeter would form an eight-sided polygon on a fully assembled refining assembly, wherein about 4% of the bars extend radially past the outermost edge circumference.

FIG. 6 depicts the terminal edge perimeter 662 that would form a sixteen-sided polygon on the refining assembly comprising four refiner plate segments 605, wherein about 15% of the bars 623 on the first refining assembly 601 extend radially past the outermost edge circumference 648 of the second refiner assembly (see 402). The depicted embodiment shows four chord segments 692 between the outer arc 624 and the terminal edges 635 of the raised bars 623. FIG. 7 depicts the terminal edge perimeter 762 that would form a twelve-sided polygon on the refining assembly comprising four refiner plate segments 705, wherein about 8% of the bars 723 on the first refining assembly 701 extend radially past the outermost edge circumference 748 of the second refiner assembly (see 402). The depicted embodiment shows three chord segments 792 between the outer arc 724 and the terminal edges 735 of the raised bars 723. FIG. 8 depicts the terminal edge perimeter 862 that would form an eight-sided polygon on the refining assembly comprising four refiner plate segments 805, wherein about 4% of the bars 823 on the first refining assembly 801 extend radially past the outermost edge circumference 848 of the second refiner assembly (see 402). The depicted embodiment shows two chord segments 892 between the outer arc 824 and the terminal edges 835 of the raised bars 823. It is understood that fewer chord segments 892 results in a greater surface area of the front face 813 without a refining surface 817 (i.e. a surface lacking alternating bars 823 and grooves 826). The lack of refining surface in these exemplary embodiments contributes to some loss of refining capacity initially, but it is contemplated that this will be recovered due to prolonged output of fibers of a desired quality without increasing energy consumption of the refiner significantly as the refiner plate segments (see 305, 405, 505, 605, 705, 805, and 905) wear.

Figure 9:
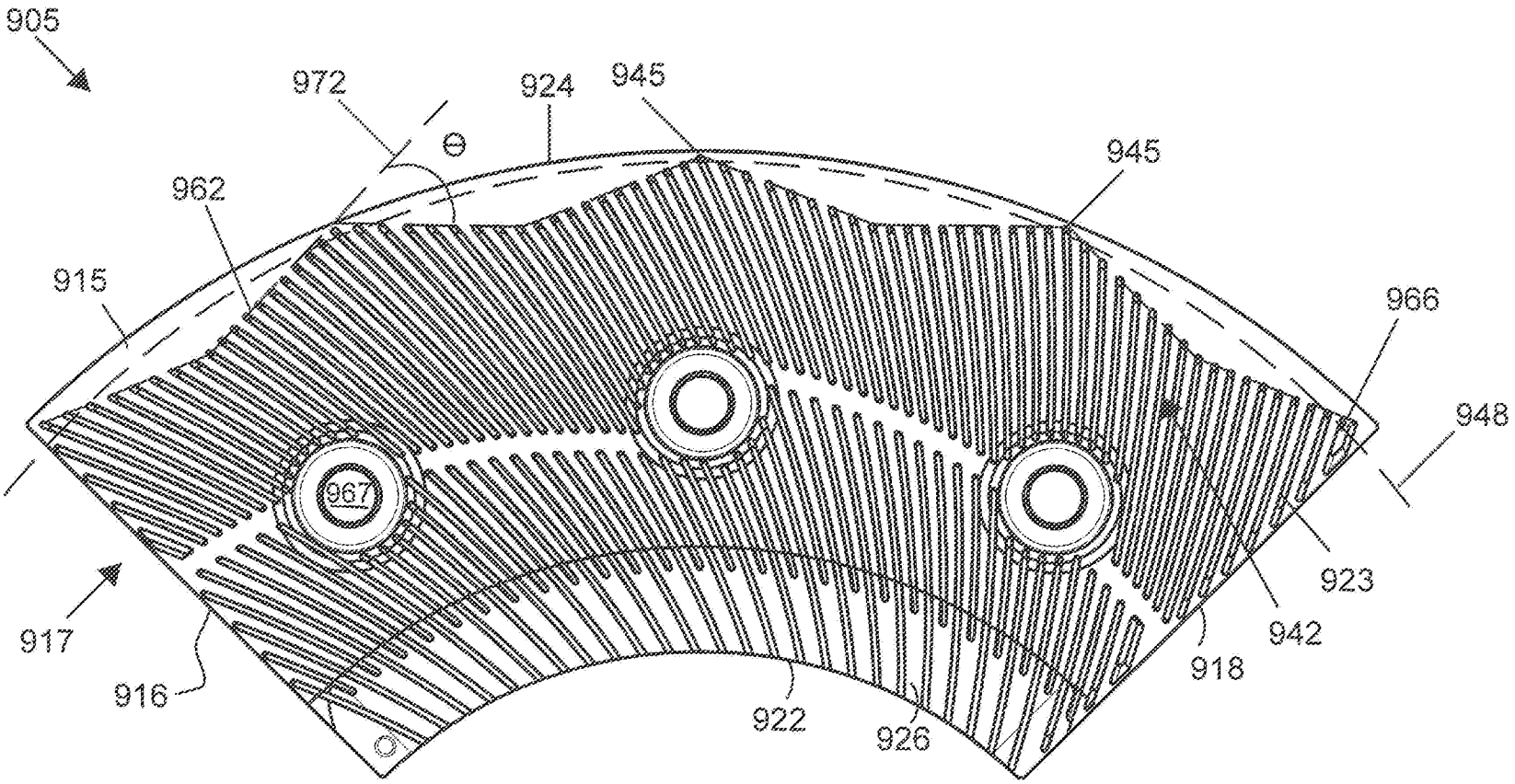
FIG. 9 is a facing view of the refining surface of an exemplary refiner plate segment wherein the terminal edge perimeter would form a forty-eight-sided polygon on a fully assembled refining assembly, wherein about 3% of the bars extend radially past the outermost edge circumference.

FIG. 9 depicts the terminal edge perimeter 962 that would form a forty-eight-sided polygon on the refining assembly comprising four refiner plate segments 905, wherein about 3% of the bars 923 on the first refining assembly 901 extend radially past the outermost edge circumference 948 of the second refiner assembly (see 402). The surface area of the front face 913 between the terminal edges 935 of the bars 923 and the outer arc 924 defines an abbreviated sector 993 bounded by adjacent outermost terminal bar edges 545. In the depicted embodiment, the terminal edges 935 of the bars 923 form multiple arrays 936 disposed at an angle 941 to adjacent arrays of terminal edges 935. The abbreviated section 993 is bounded by the outer arc 924, adjacent outermost terminal edges 945, and two arrays 936*c*, 936*d* of terminal edges 935 that converge to form a concave angle 941 relative to the outer arc 924. The depicted embodiment shows four abbreviated sectors 593. Although the outermost terminal bar edges 945 extend to the outer arc 924 in the depicted embodiment, it will be understood that in other exemplary embodiments, the outermost terminal bar edges 945 may not extend to the outer arc 924.

In the embodiments depicted in FIGS. 5-9, the terminal edge perimeter 562, 662, 762, 862, and 962 may be disposed at an edge angle Θ of between 10 degrees and 50 degrees. The edge angle Θ is an angle of the terminal edge perimeter 562, 662, 762, 862, and 962 and a tangent line 572, 672, 772, 872, and 972 at an outermost terminal bar edge of 545, 645, 745, 845, and 945 respectively of a refiner plate segment 505, 605, 705, 805, and 905.

In addition to the terminal edge perimeter (see 562, 662, 762, 862, and 962) of the first refining assembly (see 401) not being parallel to the outermost edge circumference (see 548, 648, 748, 848, and 948) of the second refining assembly (see 402), the terminal edge perimeter (see 562, 662, 762, 862, and 962) can be said to "intersect" the outermost edge circumference (see 548, 648, 748, 848, and 948) when viewing the refining surface (see 517, 617, 717, 817, and 917) of an exemplary refiner or refiner plate segment. That is, there is a point at which the terminal edge perimeter (see 562, 662, 762, 862, and 962) and outermost edge circumference (see 548, 648, 748, 848, and 948) overlap when viewed from a facing view of the refining surface (see 517, 617, 717, 817, and 917). In certain exemplary embodiments, there may be more than one point of intersection. That is, the terminal edge perimeter and the outermost edge circumference and may overlap at multiple points. In certain exemplary embodiments, the points of overlap may form a curved line (FIG. 3A). In such exemplary embodiments, the curved line may have an arc length formed of a central angle, the central angle having a value in the range of between about 5.00 degrees to about 89.99 degrees.

Without being bound by theory, it is believed that by having a majority of the s of the bars below the outermost edge circumference (see 548, 648, 748, 848, and 948) of the facing refining surface, a majority of the bars on a first refining surface will always be exposed to a bar or groove on the facing refiner surface. This configuration allows the entirety of the completely facing bars to wear away substantially at the same rate, thereby reducing the creation of lips at the terminal edges of the refiner plate segments.

An exemplary refiner plate segment for a refiner comprises: a substrate having: a radial length, an inner arc disposed at a first end of the radial length, an outer arc disposed at a second end of the radial length, the outer arc located radially distant from the inner arc along the radial length, a first lateral side extending between the inner arc and the outer arc along the radial length, a second lateral side extending between the inner arc and the outer arc along the radial length, the second lateral side being distally disposed from the first lateral side, and a back face oppositely disposed from a front face along a thickness, the back face and the front face extending between the outer arc, inner arc, first lateral side, and second lateral side, a substrate disposed between the inner arc and the outer arc, and a series of raised bars extending from the substrate, wherein adjacent bars and the substrate define a groove between adjacent bars, wherein bars near the outer arc have a terminal edge, wherein a series of adjacent terminal edges define a terminal edge perimeter, and wherein the terminal edge perimeter is not parallel to the outer arc of the substrate.

In certain exemplary embodiments, the terminal edge perimeter is disposed at an edge angle of between 10 degrees and 50 degrees, wherein the edge angle is an angle of the terminal edge perimeter and a tangent line at an outermost terminal edge of a bar disposed near the outer arc of the substrate. In certain exemplary embodiments, the terminal edge perimeter is an arc.

In certain exemplary embodiments, the terminal edge perimeter is configured to overlap an outermost edge circumference defined by an outermost terminal bar edge of a bar disposed closest to an outer arc of a substrate of an opposing refiner plate segment, the opposing refiner plate segment having a refining surface facing the bars and grooves of the refiner plate segment, such that the terminal edge perimeter of the refiner plate segment and the outermost edge circumference of the opposing refiner plate segment overlap at a point. Certain exemplary embodiments comprise multiple points of overlap, and wherein the multiple points of overlap form a curved line. The curved line can have an arc length formed of a central angle, wherein the central angle has a value in the range of between about 5.00 degrees to about 89.99 degrees. In certain exemplary embodiments, a surface area between the terminal edge perimeter and the outer arc of the refiner plate segment comprises a first distance and a second distance, wherein the first distance is greater than a second distance. In such exemplary embodiments, the surface area may define a shape consisting essentially of: a lune, a chord segment, and an abbreviated sector.

In another exemplary embodiment, a refiner comprises: at least two facing refining assemblies, wherein each of the at least two facing refining assembly comprises a backing structure and refiner plate segments engaged to the backing structure, each refiner plate segment comprising: a substrate having an outer arc, and a series of alternating bars and grooves disposed on the substrate, wherein an area between the bars and the substrate defines a groove, wherein the series of alternating bars and grooves defines a refining surface, wherein a first refining assembly of the at least two facing refiner assemblies is configured to rotate around an axis of rotation, wherein the refining surface of the a first refining assembly faces the refining surface of a second refining assembly, wherein the refiner plate segments of the first refining assembly have a terminal edge perimeter defined by two or more terminal edges of bars disposed closest to the outer arc of the substrate of the first refining assembly, wherein the refiner plate segments of the second refining assembly have an outermost edge circumference defined by an outermost terminal bar edge of a bar disposed closest to the outer arc of the substrate of the second refining assembly, and wherein the terminal edge perimeter of the first refining assembly is not parallel to the outermost edge circumference of the second refining assembly.

In certain exemplary embodiments, the terminal edge perimeter is not equidistant from the axis of rotation at all points along the terminal edge perimeter. The terminal edge perimeter on a single refiner plate segment can be disposed in: a line segment, a series of line segments, a curve, a series of curves, and a combination thereof. The terminal edge perimeter may form a shape on the front face of a fully assembled refining assembly, the shape being selected from the group consisting of: a rounded polygon, a regular polygon, an irregular polygon, an ovoid, and a combination thereof.

In certain exemplary embodiments, the terminal edge perimeter forms a 24-sided polygon on the first refining assembly and about 50% of the bars on the first refining assembly extend radially outward past the facing outermost edge circumference of the second refiner assembly. In other exemplary embodiments, the terminal edge perimeter forms a 16-sided polygon on the first refining assembly and about 15% of the bars on the first refining assembly extend radially outward past the facing outermost edge circumference of the second refiner assembly. In still other exemplary embodiments, the terminal edge perimeter forms a 12-sided polygon on the first refining assembly and about 8% of the bars on the first refining assembly extend radially outward past the facing outermost edge circumference of the second refiner assembly. In yet other exemplary embodiments, the terminal edge perimeter forms an 8-sided polygon on the first refining assembly and about 4% of the bars on the first refining assembly extend radially outward past the facing outermost edge circumference of the second refiner assembly.

While this invention has been particularly shown and described with references to exemplary embodiments thereof, it will be understood by those skilled in the art that various changes in form and details may be made therein without departing from the scope of the invention encompassed by the appended claims.

What is claimed is:

1. A refiner plate segment for a refiner comprising:

a substrate having:

a radial length;

an inner arc disposed at a first end of the radial length;

an outer arc disposed at a second end of the radial length, the outer arc located radially distant from the inner arc along the radial length;

a first lateral side extending between the inner arc and the outer arc along the radial length;

a second lateral side extending between the inner arc and the outer arc along the radial length, the second lateral side being distally disposed from the first lateral side; and a back face oppositely disposed from a front face along a thickness, the back face and the front face extending between the outer arc, inner arc, first lateral side, and second lateral side;

the substrate disposed between the inner arc and the outer arc; and a series of raised bars extending from the front face of the substrate, wherein adjacent bars and the substrate define a groove between adjacent bars, wherein bars near the outer arc have a terminal edge, wherein a series of adjacent terminal edges define a terminal edge perimeter, wherein the terminal edge perimeter is an arc, and wherein the terminal edge perimeter is not parallel to the outer arc of the substrate.

2. The refiner plate segment of claim 1, wherein the terminal edge perimeter is disposed at an edge angle of between 10 degrees and 50 degrees, wherein the edge angle is an angle of the terminal edge perimeter and a tangent line at an outermost terminal edge of a bar disposed near the outer arc of the substrate.

3. The refiner plate segment of claim 1, wherein the terminal edge perimeter is configured to overlap an outermost edge circumference defined by an outermost terminal bar edge of a bar disposed closest to an outer arc of a substrate of an opposing refiner plate segment, the opposing refiner plate segment having a refining surface facing the bars and grooves of the refiner plate segment, such that the terminal edge perimeter of the refiner plate segment and the outermost edge circumference of the opposing refiner plate segment overlap at a point.

4. The refiner plate segment of claim 3 further comprising multiple points of overlap, and wherein the multiple points of overlap form a curved line.

5. The refiner plate segment of claim 4, wherein the curved line has an arc length formed of a central angle, wherein the central angle has a value in a range of between about 5.00 degrees to about 89.99 degrees.

6. The refiner plate segment of claim 1, wherein a surface area between the terminal edge perimeter and the outer arc of the refiner plate segment comprises a first distance and a second distance, wherein the first distance is greater than a second distance.

7. The refiner plate segment of claim 6, wherein the surface area defines a shape consisting essentially of: a lune, a chord segment, and an abbreviated sector.

8. A refiner plate segment for a refiner comprising:

a substrate having:

a radial length;

an inner arc disposed at a first end of the radial length;

an outer arc disposed at a second end of the radial length, the outer arc located radially distant from the inner arc along the radial length;

a first lateral side extending between the inner arc and the outer arc along the radial length;

a second lateral side extending between the inner arc and the outer arc along the radial length, the second lateral side being distally disposed from the first lateral side; and a back face oppositely disposed from a front face along a thickness, the back face and the front face extending between the outer arc, inner arc, first lateral side, and second lateral side;

the substrate disposed between the inner arc and the outer arc; and a series of raised bars extending from the front face of the substrate, wherein adjacent bars and the substrate define a groove between adjacent bars, wherein bars near the outer arc have a terminal edge, wherein a series of adjacent terminal edges define a terminal edge perimeter, wherein the terminal edge perimeter is disposed at an edge angle of between 10 degrees and 50 degrees, wherein the edge angle is an angle of the terminal edge perimeter and a tangent line at an outermost terminal edge of a bar disposed near the outer arc of the substrate, and wherein the terminal edge perimeter is not parallel to the outer arc of the substrate.

9. The refiner plate segment of claim 8, wherein the terminal edge perimeter is configured to overlap an outermost edge circumference defined by an outermost terminal bar edge of a bar disposed closest to an outer arc of a substrate of an opposing refiner plate segment, the opposing refiner plate segment having a refining surface facing the bars and grooves of the refiner plate segment, such that the terminal edge perimeter of the refiner plate segment and the outermost edge circumference of the opposing refiner plate segment overlap at a point.

10. The refiner plate segment of claim 9 further comprising multiple points of overlap, and wherein the multiple points of overlap form a curved line.

11. The refiner plate segment of claim 10, wherein the curved line has an arc length formed of a central angle, wherein the central angle has a value in a range of between about 5.00 degrees to about 89.99 degrees.

12. The refiner plate segment of claim 8, wherein a surface area between the terminal edge perimeter and the outer arc of the refiner plate segment comprises a first distance and a second distance, wherein the first distance is greater than a second distance.

13. The refiner plate segment of claim 12, wherein the surface area defines a shape consisting essentially of: a lune, a chord segment, and an abbreviated sector.

* * * * *